US005278475A

United States Patent [19]

Jaskie et al.

[11] Patent Number: 5,278,475

[45] Date of Patent: Jan. 11, 1994

[54] CATHODOLUMINESCENT DISPLAY APPARATUS AND METHOD FOR REALIZATION USING DIAMOND CRYSTALLITES

[75] Inventors: James E. Jaskie; Lawrence Dworsky; Robert C. Kane, all of Scottsdale, Ariz.

[73] Assignee: Motorola, Inc., Schaumburg, Ill.

[21] Appl. No.: 891,004

[22] Filed: Jun. 1, 1992

[51] Int. Cl.[5] ..... G09G 3/10

[52] U.S. Cl. ..... 315/169.3; 315/169.1; 315/174; 315/349; 313/308; 313/311

[58] Field of Search ..... 315/160, 169.1, 344, 315/174, 349, 169.3; 313/308, 311, 346

[56] References Cited

U.S. PATENT DOCUMENTS 5,138,237 8/1992 Kane ..... 315/349 X 5,180,951 1/1993 Dworsky et al. ..... 315/169.3 X

*Primary Examiner*—Robert J. Pascal

*Assistant Examiner*—R. A. Ratliff

*Attorney, Agent, or Firm*—Eugene A. Parsons

[57] ABSTRACT

Cathodoluminescent display apparatus employing an electron source including a plurality of diamond crystallites. Image display apparatus employing an array of picture elements, each picture element having associated therewith an electron source including electron emitting diamond crystallites, is realized as a preferred embodiment.

9 Claims, 4 Drawing Sheets

CATHODOLUMINESCENT DISPLAY APPARATUS AND METHOD FOR REALIZATION USING DIAMOND CRYSTALLITES

FIELD OF THE INVENTION

The present invention relates generally to cathodoluminescent displays and more particularly to flat displays employing a plurality of electron sources.

BACKGROUND OF THE INVENTION

Cathodoluminescent displays are known in the art and commonly employed as image display devices and light sources. In cathodoluminescent displays visible light is generated in the device by means of photon emission induced by energetic electrons impinging on and in a layer of cathodoluminescent material disposed within the device. As such, cathodoluminescent displays require an attendant source of electrons emitted from the electron source and accelerated by an applied anode voltage toward the cathodoluminescent material (phosphor).

In one prior art method of realizing emitted electrons from the necessary electron source(s), thermal energy is provided to raise the energy level of electrons disposed in an electron emitter above that of the associated vacuum energy barrier so that electrons may be liberated to the free space region adjacent to the electron emitter and, subsequently, accelerated toward the anode on which the phosphor is disposed. Electron sources so formed and realized suffer from a number of undesirable features including poor efficiency, large size, lack of integrability, and inability to be incorporated into memory capable image display devices.

An alternative prior art cathodoluminescent display electron source employs electric field induced electron emission. Such prior art electron emitters utilize the electric field enhancing properties of structures formed with geometric discontinuities of small radius of curvature (on the order of 500 Angstroms or less) such as tips and sharp edges/wedges to achieve enhanced electric fields on the order of tens of millions of volts per centimeter ($>3\times10^7$V/cm). An improvement over other prior art electron source methods is that this technique provides for integrability, small size, and application to memory capable devices. However, a fundamental limitation of cathodoluminescent display devices, realized with electric field enhanced electron emitters employing features with geometric discontinuities of small radius of curvature, is that the fabrication methods and structures so formed are undesirably complex and limit the utility of this technique.

Accordingly there exists a need for a cathodoluminescent display apparatus, electron source, and methods for realizing the same which overcomes at least some of the shortcomings of the prior art.

SUMMARY OF THE INVENTION

It is a purpose of the present invention to provide a new electron source which may be realized without the need to employ the complex lithographic and fabrication techniques of the prior art.

It is another purpose of the present invention to provide an image display apparatus which employs electron sources which may be realized without the need to employ complex lithographic and fabrication techniques of the prior art.

It is a further purpose of the present invention to provide an image display apparatus which is not limited with respect to electron source emitting area.

It is yet another purpose of the present invention to provide methods for realization of electron sources which do not require complex lithographic and fabrication steps such as those of the prior art.

It is still another purpose of the present invention to provide electron sources and methods of realizing electron sources which employ pluralities of diamond crystallites deposited onto supporting substrate or conductive/semiconductive path material.

The above purposes and others are substantially met through provision of cathodoluminescent display apparatus including a supporting substrate having a major surface and a plurality of diamond crystallites, for emitting electrons, disposed in a random orientation on at least a part of the major surface of the supporting substrate, an insulator layer disposed on an exposed part of the major surface of the supporting substrate and further disposed on some of the diamond crystallites and having a plurality of apertures defined therethrough, a control electrode disposed on the insulator layer and substantially peripherally about at least a part of some of the apertures, and an anode, for collecting any emitted electrons and including a substantially optically transparent faceplate, a substantially optically transparent conductive layer disposed on the faceplate, and a cathodoluminescent layer disposed on the conductive layer, all in fixed space relationship and distally disposed with respect to the electron emitting diamond crystallites, such that upon application of an externally provided voltage between the optically transparent conductive layer and the supporting substrate, electrons are emitted by the diamond crystallites and collected at the optically transparent conductive layer after having first traversed the thickness of and having imparted energy to the cathodoluminescent layer to excite photon emission.

The above purposes and others are further met through provision of a method for forming an electron emitter including the steps of providing a supporting substrate having a major surface and depositing a plurality of substantially randomly oriented diamond crystallites on the major surface of the supporting substrate.

DETAILED DESCRIPTION OF THE PREFERRED EMBODIMENTS

Figure 1:
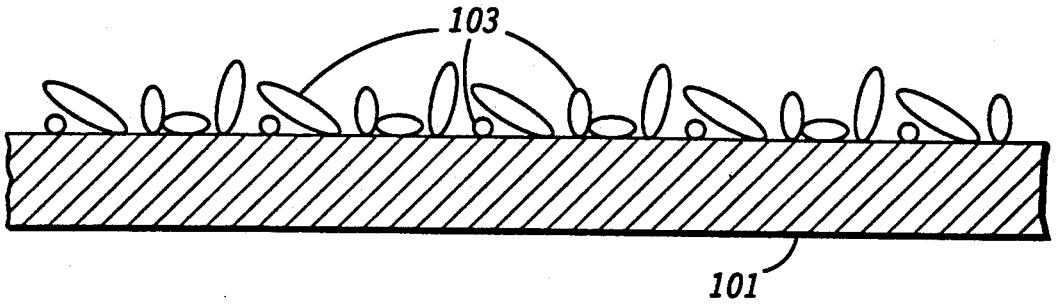
FIGS. 1–3 are partial cross-sectional representations of structures realized by performing various steps of a method in accordance with the present invention.

Referring now to FIG. 1 there is shown a partial cross sectional depiction of a plurality of electron sources (electron emitters) which are realized by performing a method in accordance with the present invention. The method generally includes the steps of providing a supporting substrate 101 having a major surface and disposing thereon a plurality of substantially randomly oriented diamond crystallites 103.

Figure 2:
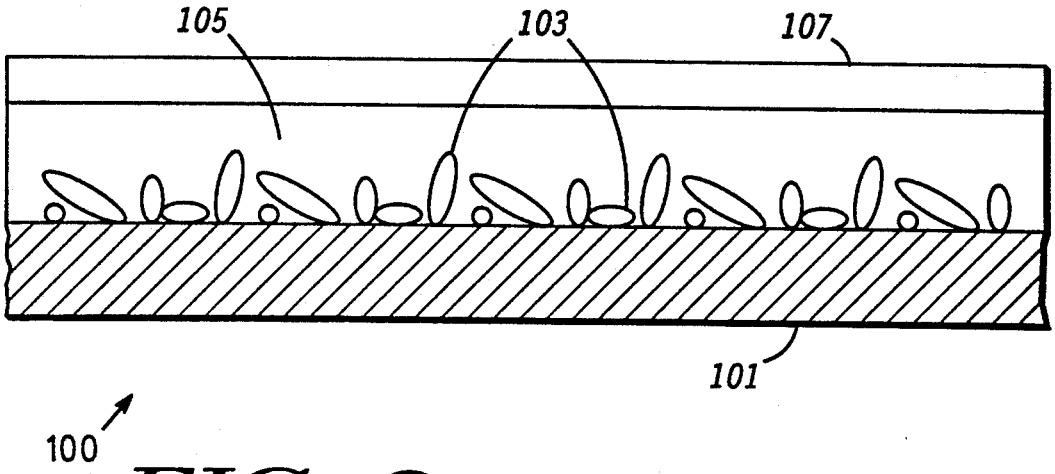

FIG. 2 is a partial cross-sectional representation of an embodiment of a structure 100 realized by performing the steps described above and further including the steps of depositing an insulator layer 105 on any exposed part of the major surface of supporting substrate 101 and on the plurality of diamond crystallites 103 and depositing a control electrode 107 on insulator layer 105. For structure 100, control electrode 107 desirably is conductive/semiconductive material.

Figure 3:
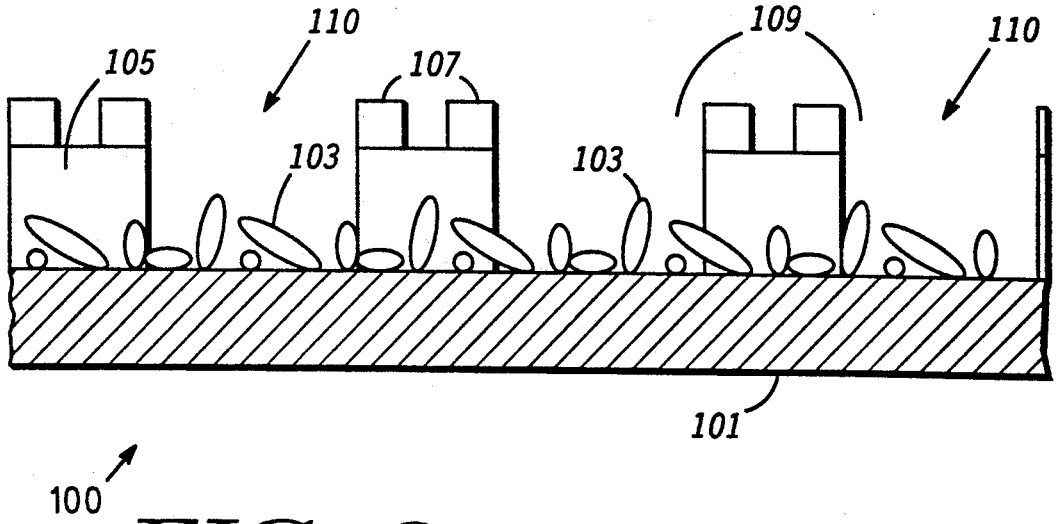

FIG. 3 depicts a partial cross-sectional representation of structure 100 having undergone the further steps of selectively removing some of the material of control electrode 107, selectively removing some of the material of insulator layer 105 such that a plurality of apertures 109 are defined therethrough exposing at least some of the plurality of diamond crystallites, and selectively removing some other material of control electrode 107 such that a plurality of discrete regions forming a plurality of control electrodes are realized each of which is disposed substantially peripherally about at least some of the apertures 109.

Other embodiments of pluralities of electron sources (electron emitters) realized in accordance with the method described above may employ a single control electrode extending substantially about each of the plurality of apertures in which instances the step of selectively removing material of the control electrode to form a plurality of control electrodes need not be performed.

Still other embodiments of an electron source may employ structures, formed in accordance with the method described herein and realizing a single aperture formed through the extent of the control electrode and insulator layer.

In the instance of the structure described in FIG. 3 the cross sectional depiction is easily seen to include a plurality of electron sources 110 each of which is situated within an aperture 109 and peripherally bounded by a control electrode 107. The control electrodes of FIG. 3 may be considered as selectively formed stripes, observed in end view, each of which has at least an aperture formed therethrough in correspondence with apertures 109 formed through insulator layer 105.

Figure 10:
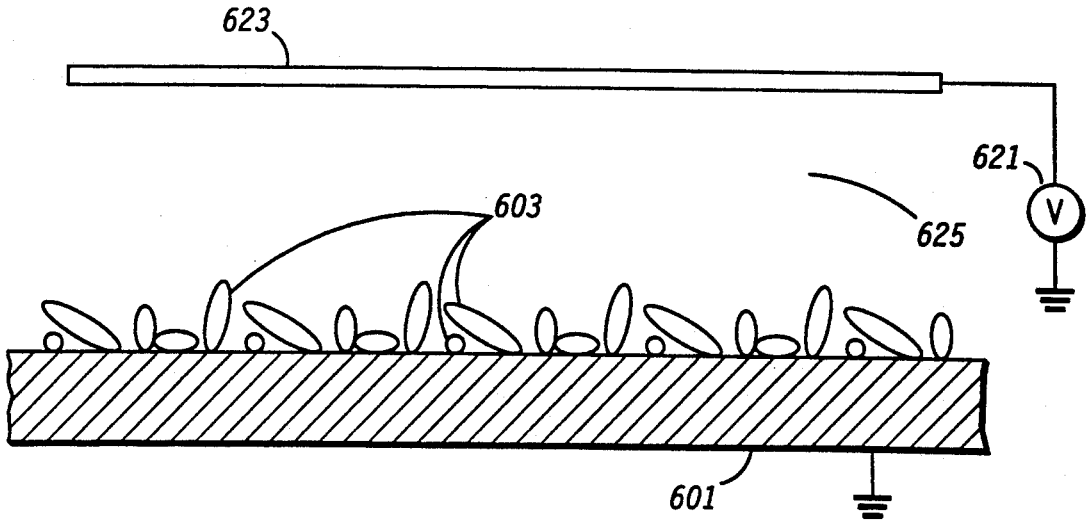
FIG. 10 is a partial cross sectional view of an embodiment of a structure employing an electron source in accordance with the present invention.

FIG. 10 depicts an electron source constructed in accordance with the present invention including the structure described previously with reference to FIG. 1 and wherein features first detailed in FIG. 1 are similarly referenced beginning with the numeral "6". A supporting substrate 601 being comprised of conductive/semiconductive material is operably coupled to a reference potential, herein depicted as ground potential. An electric field is induced at the surfaces of a plurality of diamond crystallites 603 by means of an externally provided voltage source 621 operably coupled to a distally disposed anode 623. So configured, diamond crystallites 603 (electron sources) emit electrons into a free space region 625 immediately adjacent to diamond crystallites 603, which emitted electrons are accelerated toward the anode by the induced electric field.

Figure 4:
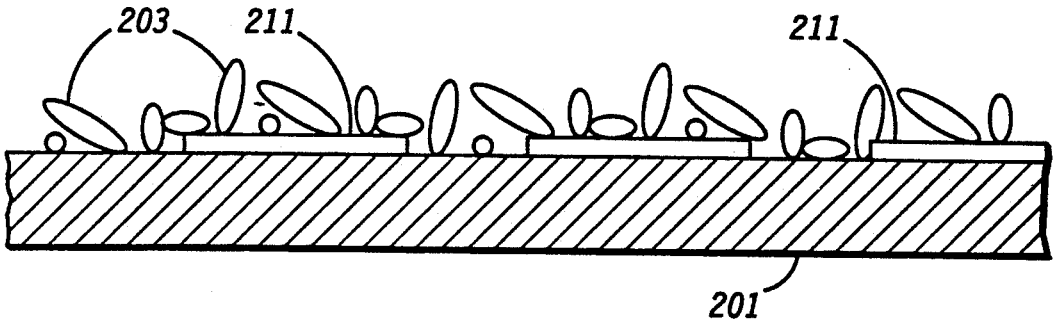
FIGS. 4–6 are partial cross-sectional representations of structures realized by performing various steps of another method in accordance with the present invention.
Figure 5:
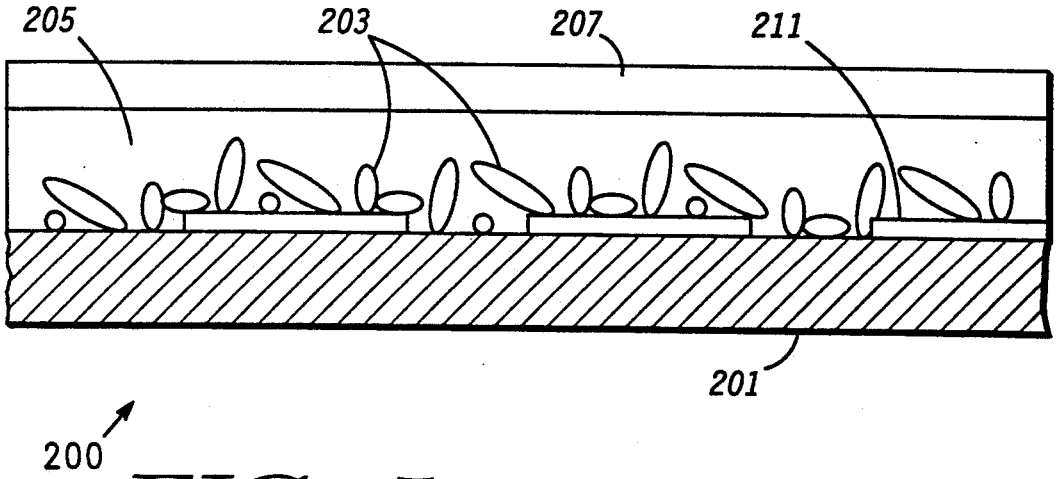
Figure 6:
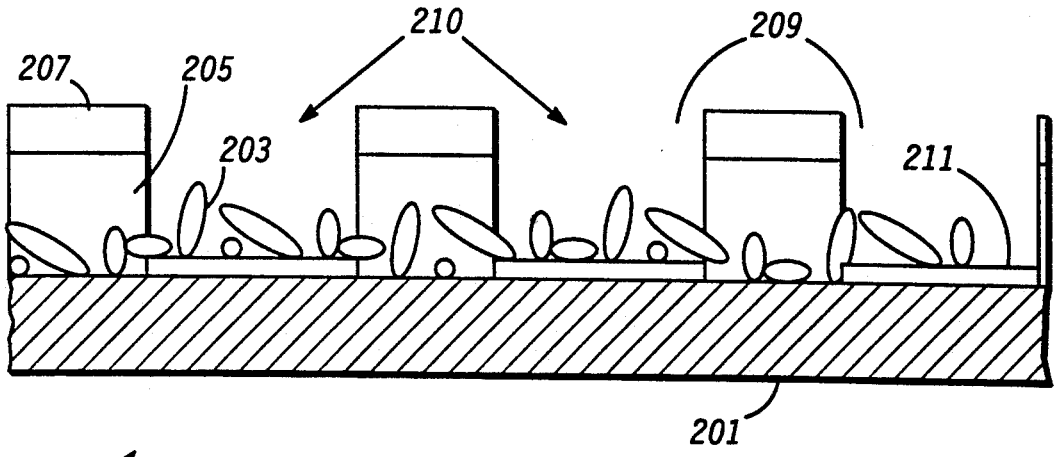

FIGS. 4-6 are cross-sectional representations of structures realized by performing various steps in accordance with another method of the present invention. In this method, referring to FIG. 4, a plurality of conductive/semiconductive paths 211 are selectively deposited onto the major surface of a supporting substrate 201. A plurality of randomly oriented diamond crystallites 203 are then deposited on the conductive/semiconductive paths 211. Electron sources realized in accordance with the method of FIGS. 4-6 desirably employes a non-conductive supporting substrate 201 to advantageously utilize the selectivity feature provided for by the addition of the plurality of conductive/semiconductive paths 211 on which the plurality of diamond crystallites 203 are disposed.

FIG. 5 is a partial cross-sectional representation of a structure 200 realized by performing the steps described above and further including the steps of depositing an insulator layer 205 on any exposed part of the major surface of the supporting substrate 201 and on the plurality of diamond crystallites 203 and depositing a control electrode 207 on insulator layer 205. For structure 200, control electrode 207 desirably is conductive/semiconductive material.

FIG. 6 depicts a partial cross-sectional representation of structure 200 having undergone the further steps of selectively removing some of the material of control electrode 207, selectively removing some of the material of insulator layer 205 such that a plurality of apertures 209 are defined therethrough exposing at least some of the plurality of diamond crystallites. FIG. 6 depicts a plurality of electron sources 110, each including those exposed diamond crystallites 203 associated with an aperture 209. Further, the plurality of conductive/semiconductive paths 211 are illustrated in end view and substantially orthogonal with respect to control electrode 207, which are represent as a plurality of control electrodes in side view. So described, the structure of FIG. 6 is includes a plurality of electron sources each of which is selectively energized and controlled by means of a matrix of addressing lines comprised of a plurality of conductive/semiconductive paths on which diamond crystallites are disposed and a plurality of control electrodes.

The electron sources, realized in accordance with the methods of FIGS. 1-3 and FIGS. 4-6, are improvements over methods and structures of the prior art since they do not employ complex formation processes such as sub-micron lithography and highly directional multiple material evaporation techniques necessary to realize electric field enhanced electron emitters. The deposition of the plurality of randomly oriented diamond crystallites may be effected by any of many commonly known methods such as, for example, the method employed to manufacture data recording media wherein an oxide material is deposited onto a substrate material and subsequently passed beneath a doctor blade to thin the material to a prescribed thickness.

Figure 7:
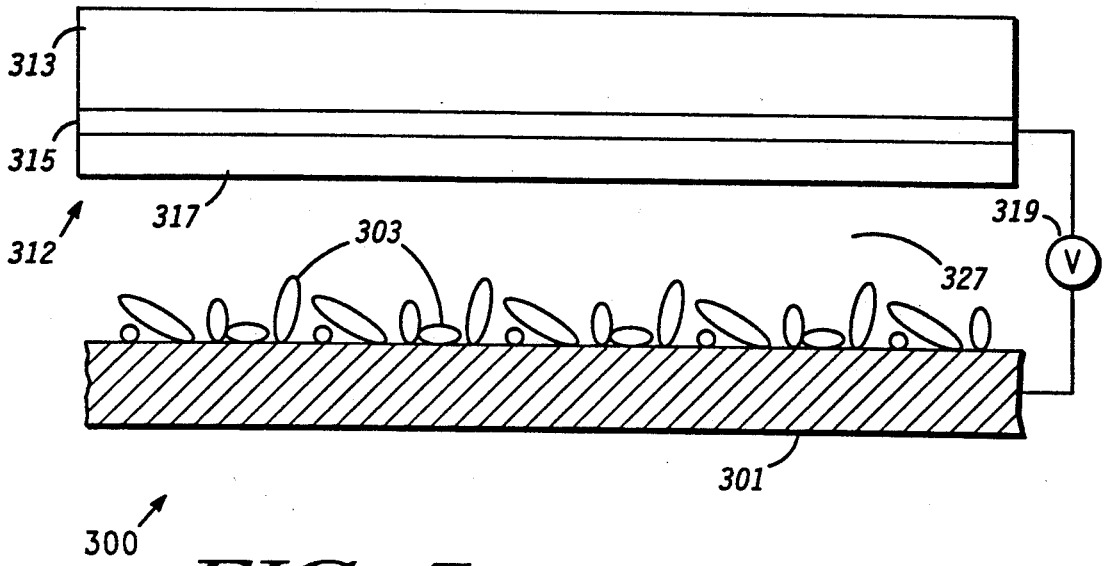
FIG. 7 is a partial cross-sectional representation of an embodiment of display apparatus in accordance with the present invention.

FIG. 7 is a cross-sectional depiction of an embodiment of display apparatus 300 in accordance with the present invention. A supporting substrate 301 having a major surface on which is disposed a plurality of randomly oriented diamond crystallites 303 is employed as an electron source (electron emitter). An anode 312 is provided and positioned distally in fixed space relationship with respect to the plurality of diamond crystallites 303. Anode 312 includes a substantially optically transparent faceplate 313 having disposed thereon a substantially optically transparent conductive layer 315 on which is disposed a cathodoluminescent layer 317. An externally provided voltage source 319 is operably coupled between supporting substrate 301 and substantially optically transparent conductive layer 315. An electric field is induced in the interspace between distally disposed anode 312 and diamond crystallites 303 by virtue of voltage source 319. The electric field causes electrons to be emitted from diamond crystallites 303 into a free space region 327, which electrons are accelerated by the electric field toward anode 312. Electrons reaching anode 312 excite photon emission in and from cathodoluminescent layer 317 prior to being collected at optically transparent conductive layer 315. Employed as described the electron source, in concert with the provided anode, comprise a cathodoluminescent display apparatus.

Figure 8:
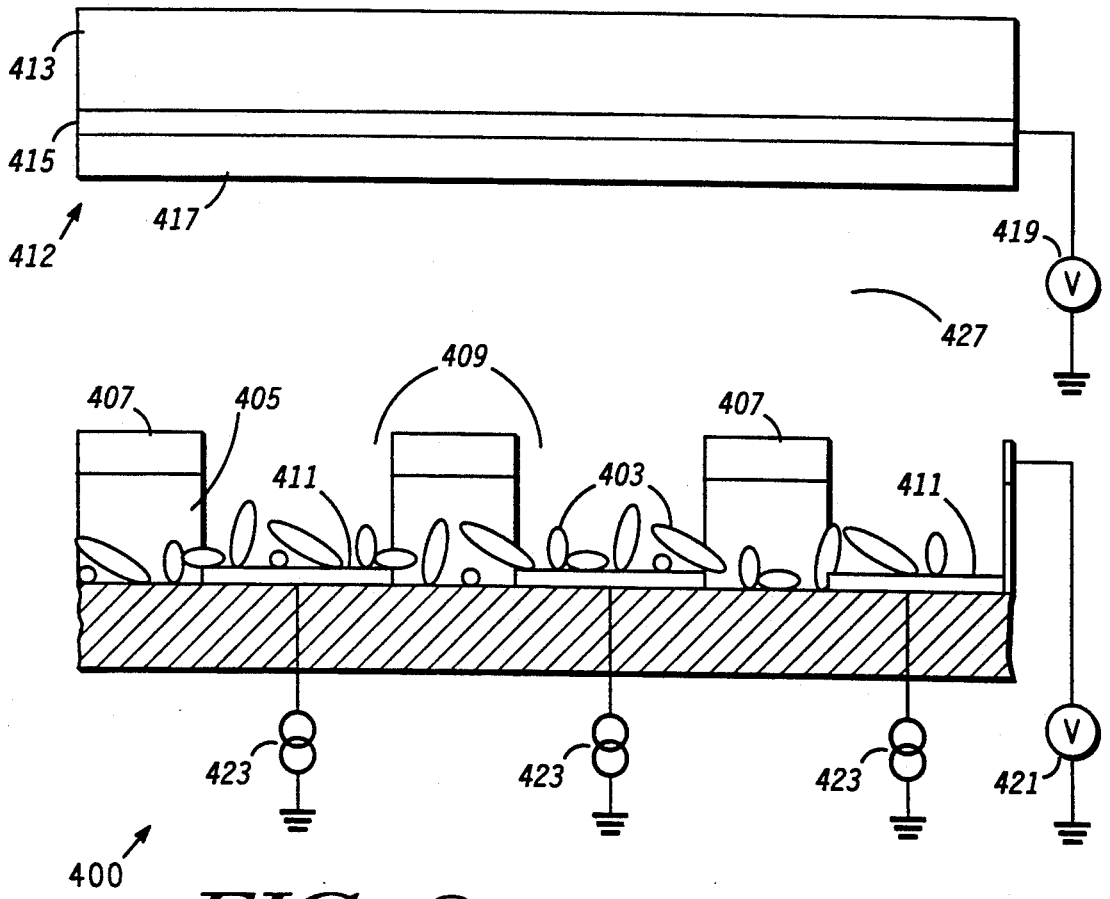
FIG. 8 is a partial cross-sectional representation of another embodiment of display apparatus in accordance with the present invention.

Referring now to FIG. 8 there is depicted a cross-sectional embodiment of image display apparatus 400 including structure similar to structure 200 described previously with reference to FIG. 6 and an anode 412 similar to anode 312 described previously with reference to FIG. 7 and wherein features described previously with reference to FIGS. 6 and 7 are similarly referenced beginning with the numeral "4". Apparatus 400 further includes a first externally provided voltage source 419 operably connected between substantially optically transparent conductive layer 415 of anode 412 and a reference potential, herein depicted as ground potential. A second externally provided voltage source 421 is operably coupled between control electrode 407 and the reference potential. It will of course be understood that voltage source 421 can be provided in a variety of configurations including fixed and/or variable voltage sources. A plurality of controlled current sources 423 are each operably coupled between a conductive/semiconductive path of the plurality of conductive/semiconductive paths 411 and a reference potential. So formed and operably connected to the externally provided sources, apparatus 400 is an image display apparatus wherein electron emission is co-incidently controlled by a combination of the voltage(s) applied to the control electrode(s) and controlled electron current provided through controlled current sources 423.

Figure 9:
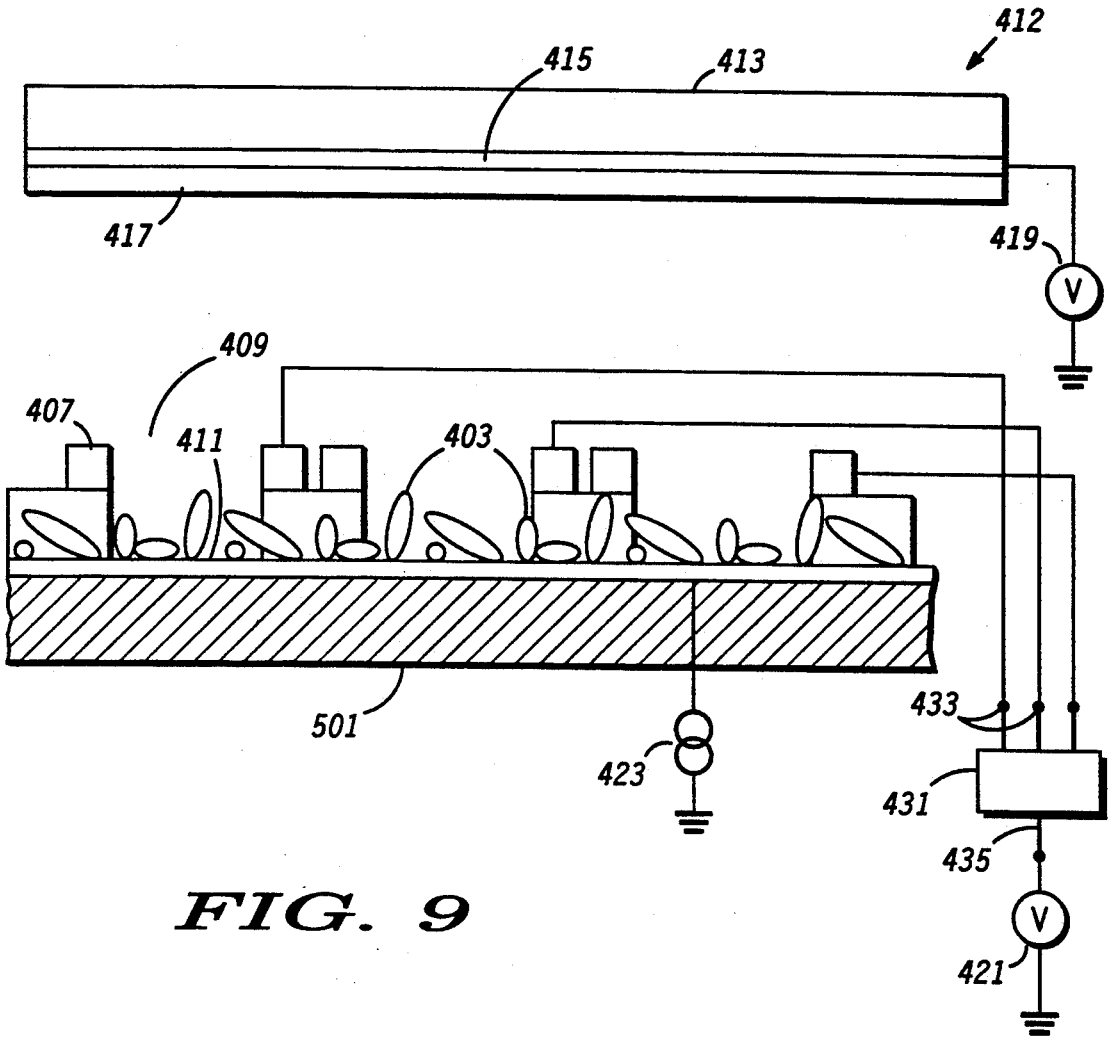
FIG. 9 is a partial cross-sectional representation of the embodiment of display apparatus illustrated in FIG. 8, rotated 90 degrees

FIG. 9 is a cross sectional view of the embodiment of image display apparatus 400, as described previously with reference to FIG. 8, rotated 90 degrees so that the plurality of control electrodes 407 are depicted in end view and the plurality of conductive/semiconductive paths 411 are depicted in side view. An externally provided switch 431 having a plurality of output terminals 433 and an input terminal 435 is shown. Output terminals 433 are operably coupled to the plurality of control electrodes 407. Voltage source 421 is operably coupled to input terminal 435 of switch 431. Switch 431 is realized by any of many commonly known means including mechanical or electronic devices and may provide functions which include, for example, selective division or reduction of the applied external voltage. Switch 431 is employed to apply an appropriate enabling voltage to a selected control electrode of the plurality of control electrodes 407 in a scanning or sequential mode. In a coherent manner, the controlled current sources 423 coupled to each of the conductive/semiconductive paths 411 source an electron current, to be emitted by the corresponding electron source associated with a particular control electrode and conductive/semiconductive path. Electrons emitted from each of the plurality of electron sources selectively energize a part of cathodoluminescent layer 417 as prescribed by the controlled current source and control electrode to provide an image which may be observed through substantially optically transparent faceplate 413. A particular electron source and associated part of cathodoluminescent layer 417 which the particular electron source energizes is known as a picture element (pixel). An image is comprised of a plurality of picture elements and in the instance of the present disclosure each picture element is comprised of an electron source realized in accordance with the present invention.

As noted previously the electron sources, realized in accordance with the methods of FIGS. 1-3 and FIGS. 4-6, and employed in the apparatus of FIG. 9 are improvements over methods and structures of the prior art since they do not employ complex formation processes such as sub-micron lithography and highly directional multiple material evaporation techniques necessary to realize electric field enhanced electron emitters. Further, due to the complex fabrication processes of the prior art it is not possible to realize large cathodoluminescent display structures, other than thermionic cathode ray tube structures, on the order of more than 100 square inches.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

What we claim is:

1. Cathodoluminescent display apparatus comprising:
a supporting substrate having a major surface;
a plurality of diamond crystallites, for emitting electrons, disposed in a random orientation on the major surface of the supporting substrate;
an insulator layer disposed on any exposed part of the major surface of the supporting substrate and further disposed on the diamond crystallites;
a plurality of apertures defined in the insulator layer and extending therethrough;
a control electrode disposed on the insulator layer and substantially peripherally about the plurality of apertures; and
an anode, for collecting emitted electrons, including a substantially optically transparent faceplate, a substantially optically transparent conductive layer disposed on the faceplate, and a cathodoluminescent layer disposed on the conductive layer, all in fixed space relationship and distally disposed with respect to the electron emitting diamond crystallites such that upon application of a voltage between the substantially optically transparent conductive layer and the supporting substrate, electrons are emitted by the diamond crystallites and collected at the substantially optically transparent conductive layer after having first traversed the thickness of and having imparted energy to the cathodoluminescent layer to excite photon emission.

2. Cathodoluminescent display apparatus comprising:
a supporting substrate having a major surface;

a plurality of conductive/semiconductive paths disposed on the major surface of the supporting substrate;

a plurality of diamond crystallites, for emitting electrons, disposed in a random orientation on the plurality of conductive/semiconductive paths;

an insulator layer disposed on any exposed part of the major surface of the supporting substrate and further disposed on the diamond crystallites;

a plurality of apertures defined in the insulator layer and extending therethrough;

a plurality of control electrodes each disposed on the insulator layer and substantially peripherally about at least a part of the apertures; and an anode, for collecting emitted electrons, including a substantially optically transparent faceplate, a substantially optically transparent conductive layer disposed on the faceplate, and a cathodoluminescent layer disposed on the conductive layer, all in fixed space relationship and distally disposed with respect to the electron emitting diamond crystallites such that upon application of a voltage between the substantially optically transparent conductive layer and the plurality of conductive/semiconductive paths, electrons are emitted by the diamond crystallites and collected at the substantially optically transparent conductive layer after having first traversed the thickness of and having imparted energy to the cathodoluminescent layer to excite photon emission and upon selective application of additional voltages to the plurality of control electrodes electron emission from diamond crystallites is modulated in accordance with the additional voltages applied to the associated control electrode.

3. Cathodoluminescent display apparatus comprising:

a supporting substrate having a major surface;

a plurality of diamond crystallites, for emitting electrons, disposed in a random orientation on the major surface of the supporting substrate;

an insulator layer disposed on any exposed part of the major surface of the supporting substrate and further disposed on the diamond crystallites;

a plurality of apertures defined in the insulator layer and extending therethrough;

a control electrode disposed on the insulator layer and substantially peripherally about at least a part of the apertures;

an anode, for collecting emitted electrons, including a substantially optically transparent faceplate, a substantially optically transparent conductive layer disposed on the faceplate, and a cathodoluminescent layer disposed on the conductive layer, all in fixed space relationship and distally disposed with respect to the electron emitting diamond crystallites, a first voltage source operably coupled to the substantially optically transparent conductive layer; and a second voltage source operably coupled to the control electrode, such that upon application of a voltage between the substantially optically transparent conductive layer and the supporting substrate, electrons are emitted by the diamond crystallites and collected at the substantially optically transparent conductive layer after having first traversed the thickness of and having imparted energy to the cathodoluminescent layer to induce photon emission.

4. Cathodoluminescent image display apparatus comprising:

a supporting substrate having a major surface;

a plurality of conductive/semiconductive paths disposed on the major surface of the supporting substrate;

a plurality of diamond crystallites, for emitting electrons, disposed in a random orientation on the plurality of conductive/semiconductive paths;

an insulator layer disposed on any exposed part of the major surface of the supporting substrate and further disposed on the diamond crystallites;

a plurality of apertures defined in the insulator layer and extending therethrough;

a plurality of control electrodes each disposed on the insulator layer and substantially peripherally about at least a part of the apertures;

an anode, for collecting emitted electrons, including a substantially optically transparent faceplate, a substantially optically transparent conductive layer disposed on the faceplate, and a cathodoluminescent layer disposed on the conductive layer, all in fixed space relationship and distally disposed with respect to the electron emitting diamond crystallites;

a first voltage source operably coupled between the substantially optically transparent conductive layer and a reference potential;

a second voltage source operably coupled between the control electrodes of the plurality of control electrodes and the reference potential; and a first controlled constant current source operably coupled between one conductive/semiconductive path of the plurality of conductive/semiconductive paths, such that by selectively applying a voltage to the substantially optically transparent conductive layer and providing controlled current to the plurality of conductive/semiconductive paths and providing voltages to the plurality of control electrodes electron emission is induced from some of the plurality of diamond crystallites and subsequently collected at the substantially optically transparent conductive layer after having first traversed the thickness of and imparted energy to the cathodoluminescent layer to induce photon emission.

5. Cathodoluminescent image display apparatus comprising:

a supporting substrate having a major surface;

a plurality of conductive/semiconductive paths disposed on the major surface of the supporting substrate;

a plurality of diamond crystallites, for emitting electrons, disposed in a random orientation on the plurality of conductive/semiconductive paths;

an insulator layer disposed on any exposed part of the major surface of the supporting substrate and further disposed on the diamond crystallites;

a plurality of apertures defined in the insulator layer and extending therethrough;

a plurality of control electrodes each disposed on the insulator layer and substantially peripherally about at least a part of the apertures;

an anode, for collecting emitted electrons, including a substantially optically transparent faceplate, a substantially optically transparent conductive layer disposed on the faceplate, and a cathodoluminescent layer disposed on the conductive layer, all in fixed space relationship and distally disposed with respect to the electron emitting diamond crystallites;

a first voltage source operably coupled between the substantially optically transparent conductive layer and a reference potential;

a switch having a plurality of output terminals operably coupled to the plurality of control electrodes and having an input terminal;

a second voltage source operably coupled between the input terminal of the switch and the reference potential; and a first controlled constant current source operably coupled between one conductive/semiconductive path of the plurality of conductive/semiconductive paths, such that by selectively applying a voltage to the substantially optically transparent conductive layer and providing controlled current to the plurality of conductive/semiconductive paths and providing voltages to the plurality of control electrodes, via the switching means, electron emission is induced from some of the plurality of diamond crystallites and subsequently collected at the substantially optically transparent conductive layer after having first traversed the thickness of and imparted energy to the cathodoluminescent layer to induce photon emission.

6. Cathodoluminescent image display apparatus comprising:

a supporting substrate having a major surface;

a plurality of picture elements each of which includes a plurality of diamond crystallites, for emitting electrons, which diamond crystallites are substantially randomly distributed and disposed in a random orientation on the major surface of the supporting substrate, an insulator layer having an aperture defined therethrough disposed on any exposed part of the major surface of the supporting substrate and on the diamond crystallites, and a control electrode disposed on the insulator layer and peripherally about at least a part of the aperture;

an anode, for collecting emitted electrons including a substantially optically transparent faceplate, a substantially optically transparent conductive layer disposed on the faceplate, and a cathodoluminescent layer disposed on the conductive layer, all in fixed space relationship and distally disposed with respect to the electron emitting diamond crystallites; and voltage and controlled current sources for independently energizing each of the plurality of picture elements, such that any electron emission from diamond crystallites of each picture element of the plurality of picture elements will energize the corresponding cathodoluminescent layer associated with the picture element to an extent determined by the controlled current source to provide an image.

7. A method for forming an electron emitter including the steps of:

providing a supporting substrate having a major surface; and depositing a plurality of substantially randomly oriented diamond crystallites on at least a part of the major surface of the supporting substrate.

8. A method for forming a plurality of controlled electron sources including the steps of:

providing a supporting substrate having a major surface;

depositing a plurality of conductive/semiconductive paths on the surface of the supporting substrate;

depositing a plurality of substantially randomly oriented diamond crystallites on the plurality of conductive/semiconductive paths;

depositing an insulator layer on any exposed part of the major surface of the supporting substrate and on the plurality of diamond crystallites;

depositing a plurality of control electrodes on the insulator layer; and selectively removing some of the material of each of the control electrodes and insulator layer to define a plurality of apertures therethrough to expose diamond crystallites of the plurality of diamond crystallites.

9. Cathodoluminescent display apparatus comprising:

a supporting substrate having a major surface;

a plurality of diamond crystallites, for emitting electrons, disposed in a random orientation on the major surface of the supporting substrate;

an anode, for collecting emitted electrons, including a substantially optically transparent faceplate, a substantially optically transparent conductive layer disposed on the faceplate, and a cathodoluminescent layer disposed on the conductive layer, all in fixed space relationship and distally disposed with respect to the electron emitting diamond crystallites such that upon application of a voltage between the substantially optically transparent conductive layer and the supporting substrate, electrons are emitted by the diamond crystallites and collected at the substantially optically transparent conductive layer after having first traversed the thickness of and having imparted energy to the cathodoluminescent layer to excite photon emission.

* * * * *